US011213878B2

(12) United States Patent
Daw et al.

(10) Patent No.: US 11,213,878 B2
(45) Date of Patent: Jan. 4, 2022

(54) APPARATUS AND METHOD FOR FORMING DUCT FLANGES AND DUCT WORK

(71) Applicant: HVAC Inventors/Systemation, Inc., Houston, TX (US)

(72) Inventors: David E. Daw, Costa Mesa, CA (US); John T. Ehling, Edison, NJ (US)

(73) Assignee: HVAC Inventors/Systemation, Inc., Houston, TX (US)

( * ) Notice: Subject to any disclaimer, the term of this patent is extended or adjusted under 35 U.S.C. 154(b) by 0 days.

(21) Appl. No.: 16/802,838

(22) Filed: Feb. 27, 2020

(65) Prior Publication Data

US 2020/0276632 A1 Sep. 3, 2020

Related U.S. Application Data

(60) Provisional application No. 62/812,754, filed on Mar. 1, 2019.

(51) Int. Cl.

| | |
|---|---|
| ***B21D 5/16*** | (2006.01) |
| ***F24F 13/02*** | (2006.01) |
| ***B21D 53/04*** | (2006.01) |

(52) U.S. Cl.

CPC ..... *B21D 53/04* (2013.01); *B21D 5/16* (2013.01); *F24F 13/0209* (2013.01)

(58) Field of Classification Search

CPC . B21D 53/04; B21D 5/16; B21D 5/04; B21D 5/042; B21D 5/01; B21D 11/20; B21D 19/00; B21D 19/02; B21D 19/04; B21D 19/08; B21D 39/02; B21D 11/10; B21D 13/04; B21D 17/04; B21D 17/00; B21D 13/045; B21D 13/08; B21D 13/10; B21D 43/02; B21D 39/023; B21D 19/16; B21D 24/005; B21D 39/021; B21D 39/037; F24F 13/0245; F24F 13/0209

USPC ..... 72/306, 315, 379.2, 379.6

See application file for complete search history.

(56) References Cited

U.S. PATENT DOCUMENTS

| | | | | |
|---|---|---|---|---|
| 2,209,472 | A * | 7/1940 | Pedaline | B21D 5/08 72/180 |
| 3,251,209 | A * | 5/1966 | Cookson | B21D 13/045 72/181 |
| 3,269,164 | A * | 8/1966 | Rutter | B21D 39/02 72/294 |
| 3,724,255 | A | 4/1973 | Molino | |
| 3,726,120 | A | 4/1973 | Hugert | |
| 3,815,398 | A | 6/1974 | McClain | |
| 3,903,723 | A | 9/1975 | Colbath | |
| 3,994,152 | A | 11/1976 | Wolters | |
| 4,558,582 | A | 12/1985 | Meinig | |
| 4,594,867 | A | 6/1986 | Andersen | |
| 5,105,640 | A | 4/1992 | Moore | |
| 5,163,311 | A | 11/1992 | McClain et al. | |
| 5,394,722 | A | 3/1995 | Meyer | |

(Continued)

*Primary Examiner* — Adam J Eiseman
*Assistant Examiner* — Sarkis A Aktavoukian
(74) *Attorney, Agent, or Firm* — Breiner & Breiner, L.L.C.

(57) ABSTRACT

An apparatus and method are disclosed for the automated manufacture of a duct flange profile to make small duct fittings, including a transverse duct flange duct flange profile. The duct flange profile is directed to small part duct fittings with section widths up to about 16 inches in 20 to 26 gauge metal. The apparatus includes a bending head assembly having a drive roller, a pressure roller, an anvil and a bending leaf and a roll form assembly.

14 Claims, 19 Drawing Sheets

STEP 5

(56) References Cited

U.S. PATENT DOCUMENTS

| | | | | |
|---|---|---|---|---|
| 5,462,424 | A | 10/1995 | Kuroyone | |
| 5,722,278 | A | 3/1998 | Horino et al. | |
| 5,746,082 | A | 5/1998 | Matsuoka | |
| 5,784,916 | A | 7/1998 | Matsuoka | |
| 6,148,654 | A | 11/2000 | Jensen et al. | |
| 6,216,514 | B1 | 4/2001 | Bradbury et al. | |
| 6,446,478 | B1 | 9/2002 | Muller | |
| 6,460,573 | B1 | 10/2002 | Fischer et al. | |
| 6,467,324 | B2 | 10/2002 | Patrick | |
| 6,928,848 | B2 | 8/2005 | Golovashchenko et al. | |
| 7,104,104 | B1 | 9/2006 | Hermanson | |
| 7,234,734 | B2 | 6/2007 | Borwig et al. | |
| 7,296,455 | B2 | 11/2007 | Durney | |
| 7,487,659 | B2 | 2/2009 | Paletto | |
| 7,490,872 | B2 | 2/2009 | Yamamoto et al. | |
| 8,186,197 | B2 | 5/2012 | Walle | |
| 8,276,425 | B2 | 10/2012 | Borwig et al. | |
| 8,499,604 | B2 | 8/2013 | Borwig et al. | |
| 8,561,448 | B2 | 10/2013 | Borwig | |
| 8,695,394 | B2 | 4/2014 | Makino | |
| 9,459,019 | B2 | 10/2016 | Runyan | |
| 2002/0067950 | A1 | 6/2002 | Price et al. | |
| 2003/0084793 | A1* | 5/2003 | Schoch | B21D 43/00 100/144 |
| 2004/0143954 | A1 | 7/2004 | Walsh | |
| 2012/0304725 | A1* | 12/2012 | Wallinder | B21D 17/04 72/179 |
| 2016/0236257 | A1* | 8/2016 | Kajino | B21D 19/16 |
| 2017/0008061 | A1* | 1/2017 | Kohno | B21D 24/02 |

* cited by examiner

Step 1 Start position is: Bending leaf @ 90 deg. for loading stop anvil, (cyl 54A retracted cyl 54B extended) and pressure roller Up so metal can be loaded
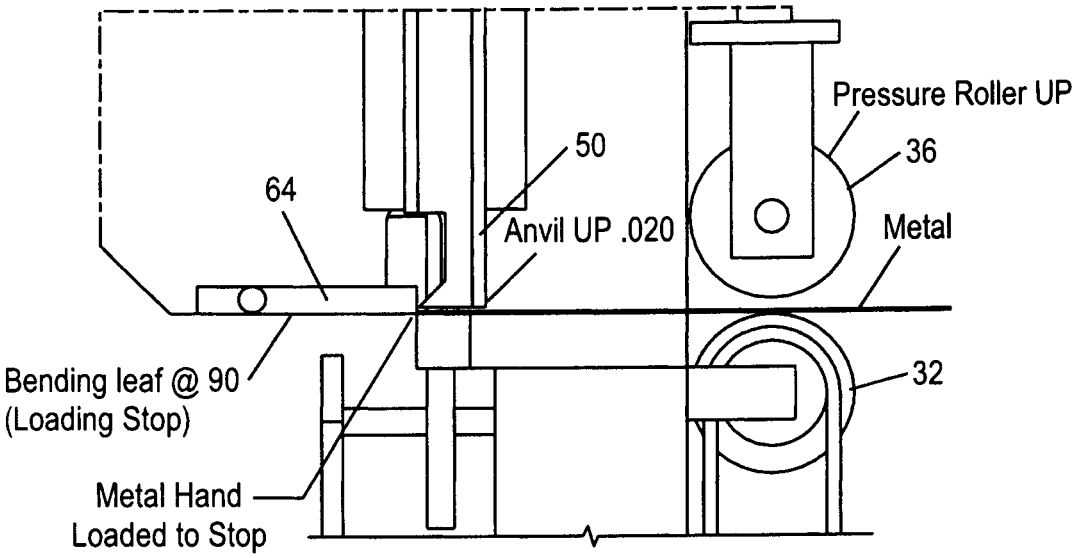
FIG. 12A STEP 1
Step 2 Pressure roller is driven down to clamp metal against the servo driven drive roller
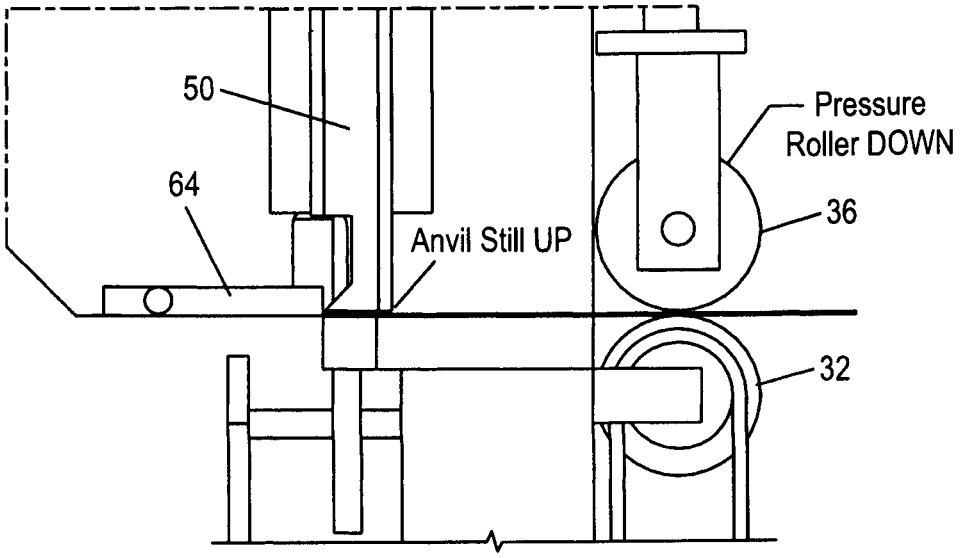
FIG. 12B STEP 2

Step 3 Bending Leaf rotated down, Anvil still UP, metal is advanced by servo to position for hem pre bend
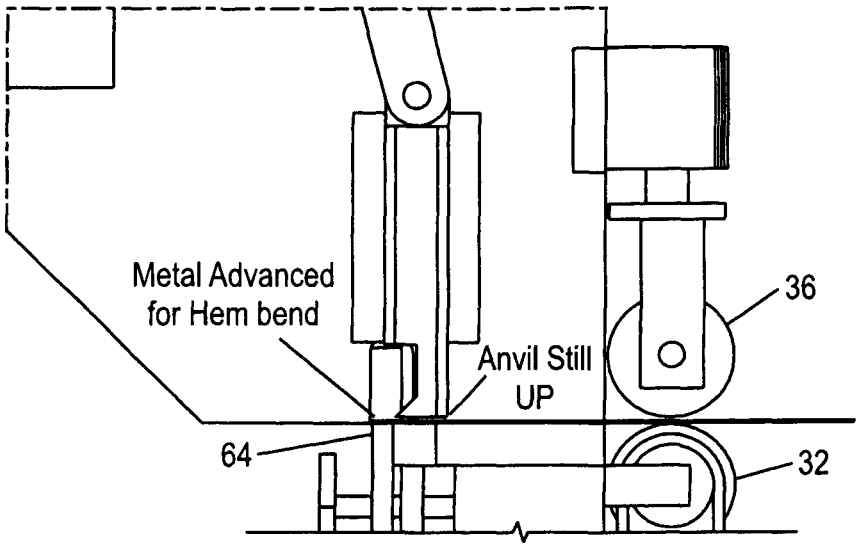
FIG. 12C STEP 3
Step 4 Anvil is driven by toggle mechanism (cyl 54A & 54B extended) to clamp metal against the platen
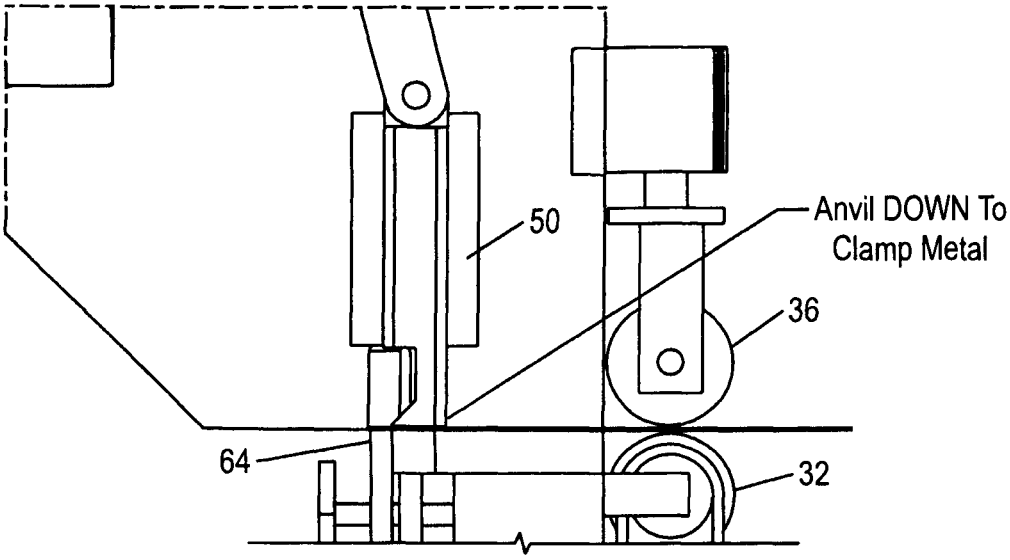
FIG. 12D STEP 4

Step 5 Bending leaf is rotated by servo 135 deg. to over-bend metal for hem
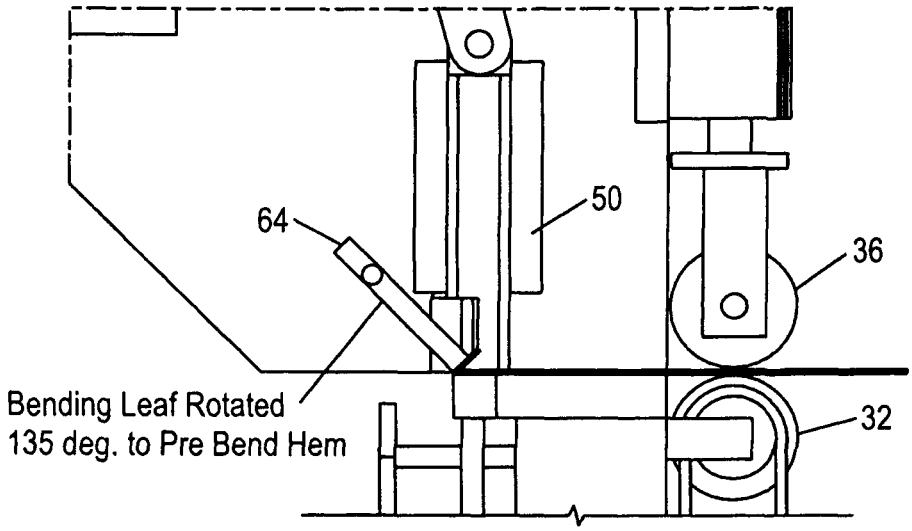
FIG. 12E STEP 5
Step 6 Anvil is raised .020 (Cyl 54A retracted) and metal is advanced by servo so pre-bend is past the anvil
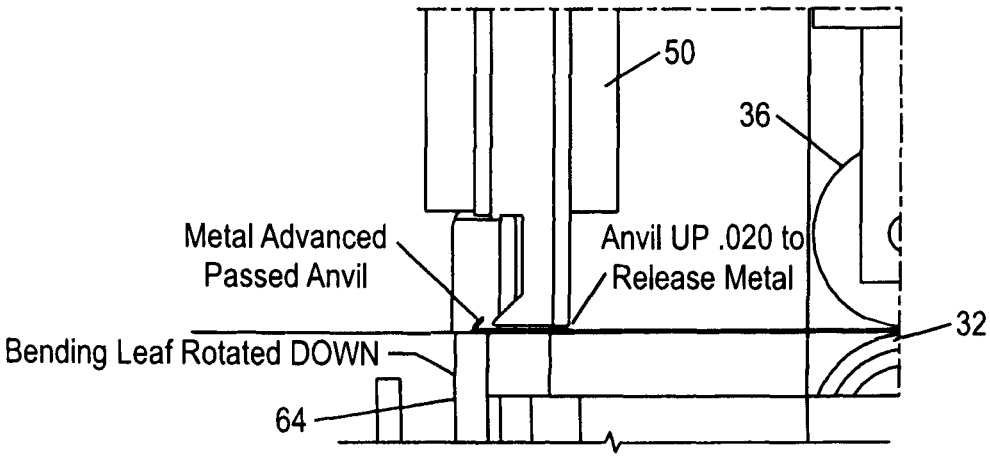
FIG. 12F STEP 6

Step 7 Anvil is raised so hem pre-bend can fit under the anvil (Cyl 54A & 54B retracted) and metal is retracted to position hem under the anvil
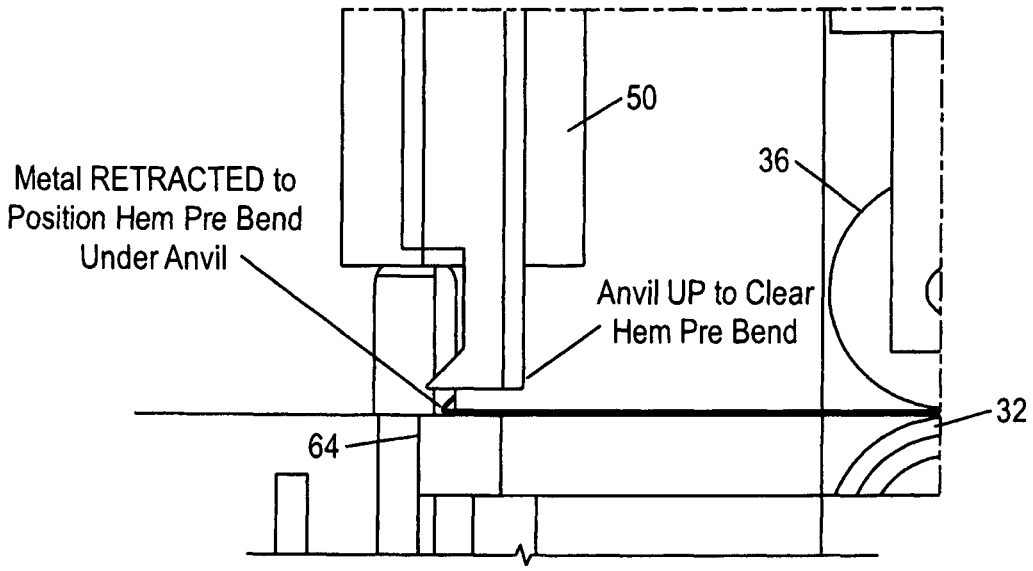
FIG. 12G STEP 7
Step 8 Cylinders 54A and 54B extend to drive the anvil down flattening the hem
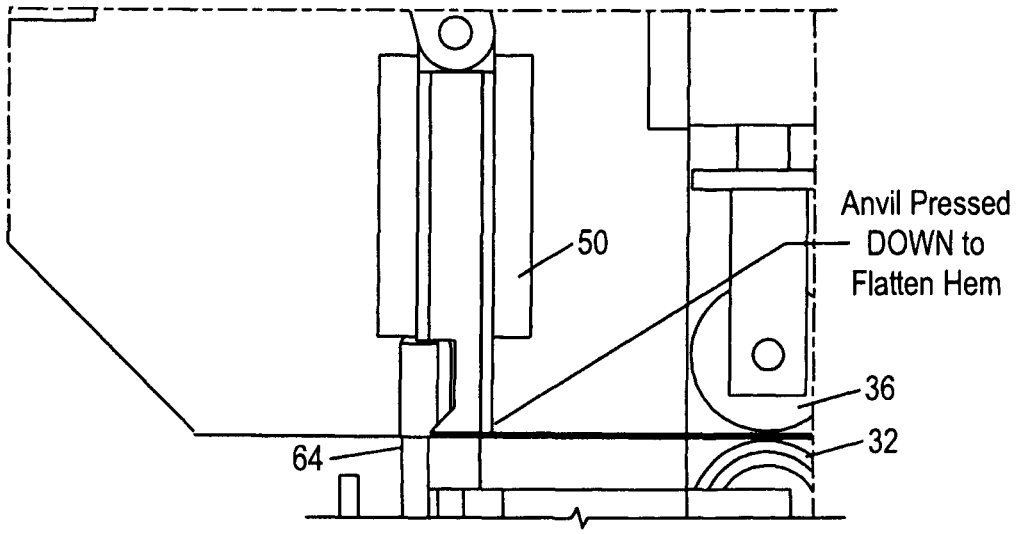
FIG. 12H STEP 8

Step 9 Anvil is raised to release metal by retracting cyl 54B, and metal is advanced by servo to position for bending the lip
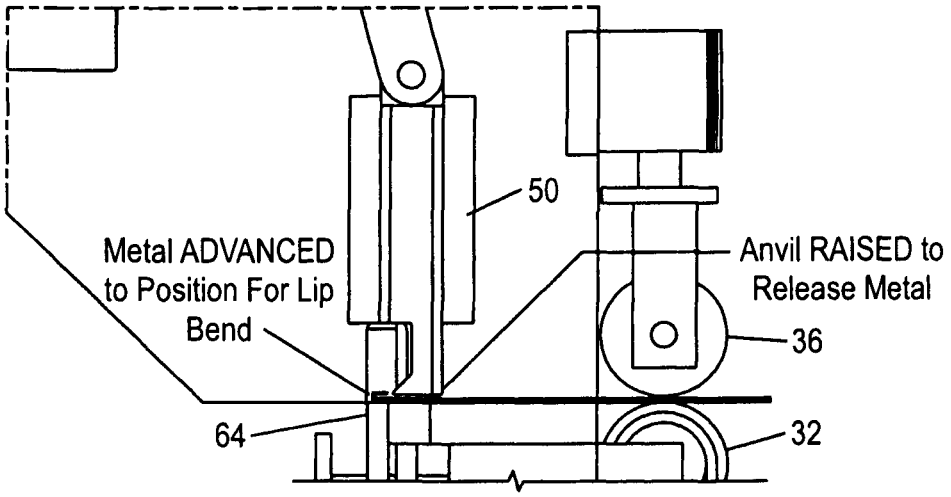
FIG. 12I STEP 9
Step 10 Anvil is driven down (extend cyl 54B) then bending leaf is rotated up to bend the lip
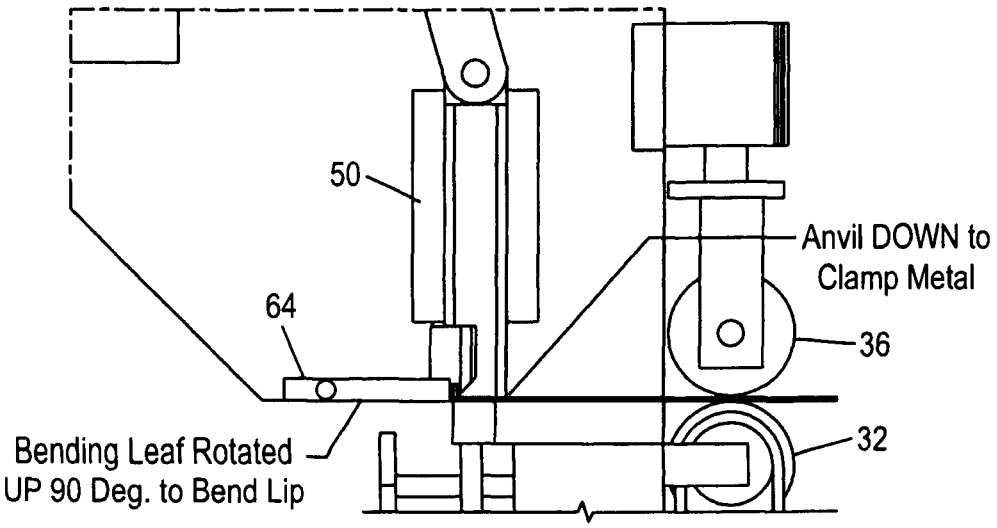
FIG. 12J STEP 10

Step 11 Rotate bending leaf down, raise anvil to release metal (retract cyl 54A) and advance metal to position for bending the flange
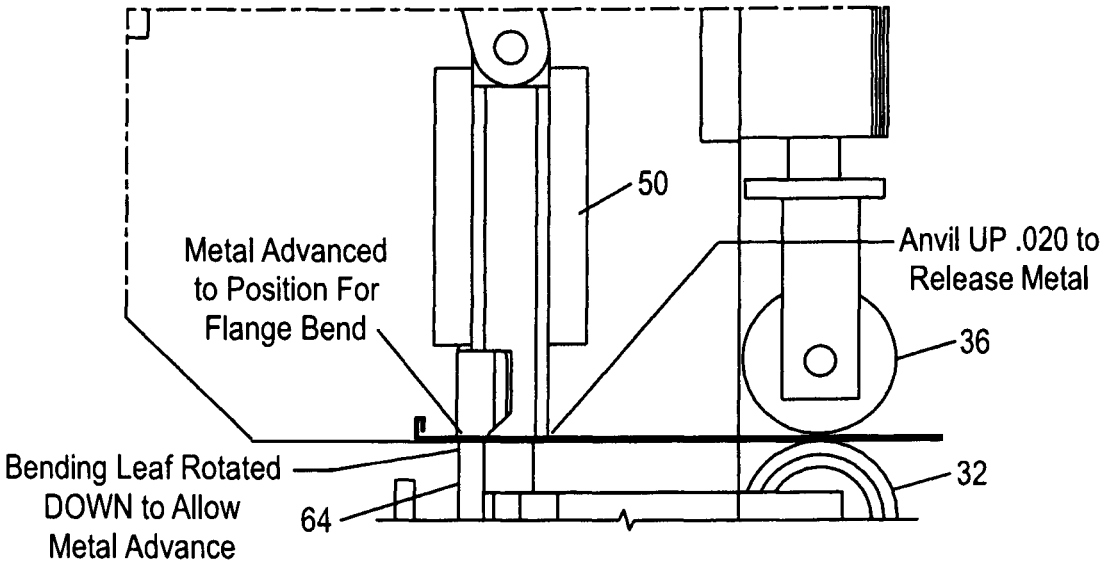
FIG. 12K STEP 11
Step 12 Anvil is driven down to clamp (extend cyl 54A) and rotate bending leaf up 90 deg. to bend the flange
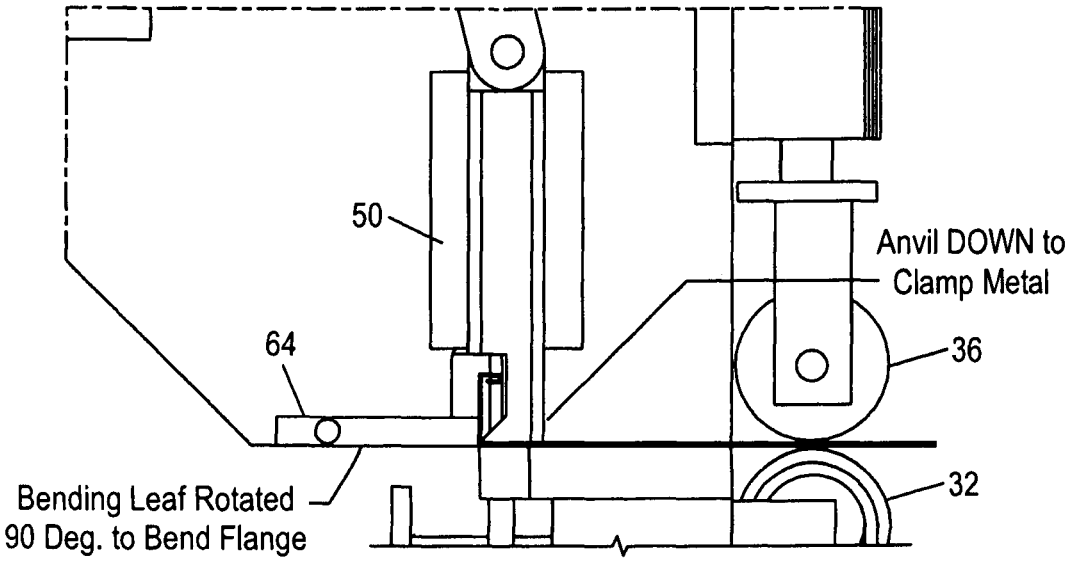
FIG. 12L STEP 12

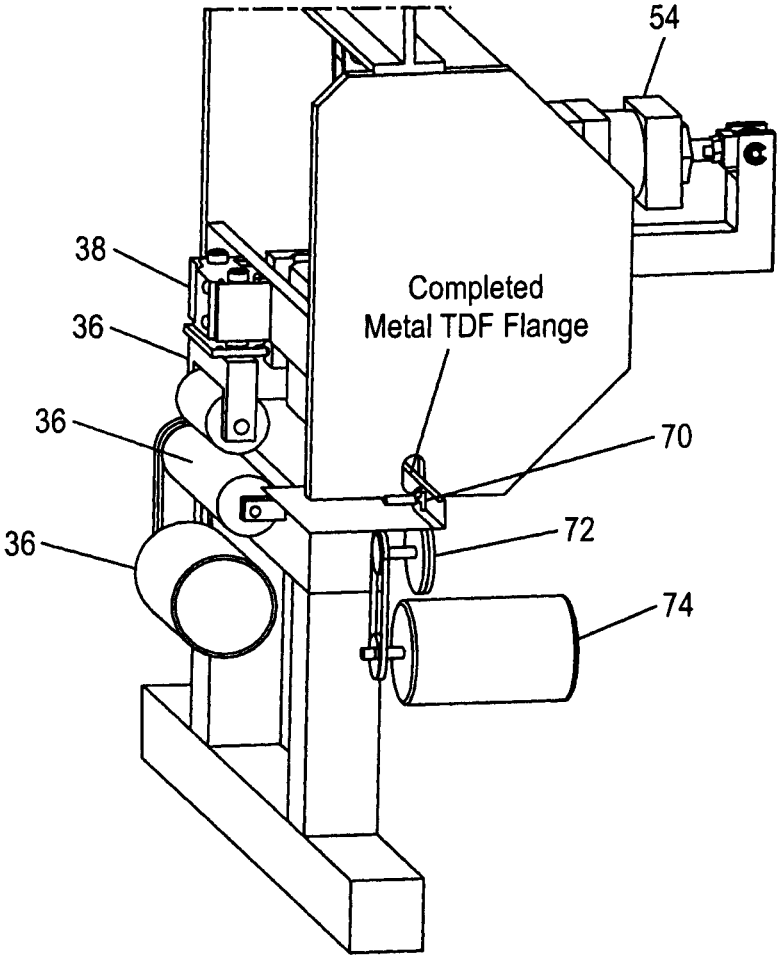
FIG. 12M STEP 13

APPARATUS AND METHOD FOR FORMING DUCT FLANGES AND DUCT WORK

RELATED APPLICATION

This application claims benefit of U.S. Provisional Application Ser. No. 62/812,754, filed Mar. 1, 2019, entitled "Apparatus And Method For Forming Duct Flanges And Duct Work," and which is incorporated herein by reference in its entirety.

FIELD OF THE INVENTION

The present invention relates to an apparatus and method for forming duct flanges and particularly TDF and TDC duct flanges for duct work. More particularly, the invention relates to an apparatus and method for forming duct flanges using an automated bending apparatus.

BACKGROUND OF THE INVENTION

Transverse duct flanges (TDF) are known in the art, including as disclosed in U.S. Pat. No. 4,579,375, which is incorporated herein by reference. Similarly, transverse duct connectors (TDC) are known in the art as disclosed in U.S. Pat. No. 4,466,641, which is incorporated herein by reference. The TDF and TDC duct flanges have had a significant impact on the duct industry. Over the last thirty years or so, the use of TDF and TDC duct flanges has grown exponentially. In many cases, the use of TDF and TDC duct flanges have taken market share from Slip and Drive Connections. It is believed that this is due to the speed of installation, better sealing and fabrication standardization which is becoming the preferred method worldwide.

The known apparatus and methods for making TDF and TDC duct flanges use roll forming to form the duct flanges. These apparatus work well with large ducts. However, for small duct fittings as shown, for example, in FIG. 1, the current apparatus for manufacturing TDF and TDC duct flanges have significant limitations. Accordingly, for such small duct fittings, a small parts feeder is required to make the TDF or TDC duct flanges. The use of a small parts feeder includes multiple steps and it is a difficult and time consuming process. For example, this is because the machine roll sets are six inches on center. Device clamps are needed to lock the duct to a slider and then it is hand pushed through either twelve or sixteen station machines. Sometimes, the part spins out destroying it. This necessitates manufacturing a new part, thereby adding material and significant time which disrupts the fabrication process. In search of a better method, some contractors are using a press brake to form a duct channel. However, duct flange profiles made by using a press brake do not conform to SMACNA (Sheet Metal And Air Conditioning Contractors' National Association) standards as generally required in the industry.

Accordingly, there is a substantial need in the industry for an apparatus and method for making small part duct fittings having a TDF or TDC flange profile. The present invention addresses the shortcomings of the current apparatus and methods for making small part duct fittings having TDF or TDC flanges.

SUMMARY OF THE INVENTION

A primary object of the invention is to provide an apparatus and method for forming duct flanges and duct work.

Another primary object of the invention is for providing an apparatus and method for forming duct flanges having a TDF or TDC profile.

Another primary object of the invention is for providing an apparatus and method for forming duct flanges having a TDF or TDC profile for fabricating small part duct fittings.

Another primary object of the invention is to provide an apparatus and method for forming duct flanges having a TDF or TDC profile which will reduce the time in the manufacture of small part duct fittings.

Another primary object of the invention is to provide an apparatus and method for forming duct flanges having a TDF or TDC profile which meets industry standards, including SMACNA standards.

Another primary object of the invention includes providing an apparatus and method for forming duct flanges having TDF or TDC profiles which is automated and substantially faster than the known apparatus and methods.

Another primary object of the invention is to eliminate damage to the parts inherent in the known manufacturing process of small part duct fittings.

Another primary object of the invention is to facilitate better shop flow and reduce redundancy in operation, e.g. the number of worker steps, thereby saving the fabricators time and expense. For example, the present invention is about one half of the size of current roll forming machines, and such a small foot print may allow for a more versatile and optimized floor layout.

Another primary object of the invention is that the sheet metal blanks to be formed with the TDF or TDC flange will thereafter be assembled to make a small duct fitting having a longitudinal lock, e.g. a Pittsburgh lock or a Snap lock.

Another primary object of the invention is for providing an apparatus and method for forming duct flanges having a TDF or TDC profile which is simple in construction, inexpensive in manufacture and durable in use.

The apparatus of the invention comprises an apparatus for forming from a sheet metal blank a TDF or TDC duct flange for a duct comprising an apparatus and method as shown in the accompanying drawings and described herein.

There is disclosed an apparatus for making a TDF flange for use in the manufacture of a small duct fitting comprising a bending head assembly for forming an intermediate TDF profile flange having a duct wall, a web and a flange comprising a platen for receiving a piece of sheet metal to be bent to form the TDF flange, a drive roller to move the sheet metal forward and backwards, an anvil for holding the sheet metal in a fixed position at various points in the process of making the TDF flange and for bending the sheet metal at various points in the process of making the TDF flange, a bending leaf for bending the sheet metal and a roll form assembly for forming a bead of a TDF profile, wherein the bending head assembly and roll form assembly form the TDF duct flange. Other components may also be used including a pressure roll assembly.

A method of making a TDF flange for use in the manufacture of a small duct fitting comprising the steps of inserting a piece of sheet metal into an apparatus for making the TDF flange comprising a bending head assembly and a roll forming assembly; wherein the bending head assembly and roll form assembly form the TDF duct flange through the following steps: the sheet metal is bent to make a hem prebend, the hem prebend is bent to form a flange, the flange is bent to form a lip, the lip is bent to form an intermediate TDF profile, and a TDF bead is formed in the duct wall to provide the finished TDF flange.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

FIGS. 12A-12M illustrate steps 1 through 13 showing the operation of the apparatus to make an intermediate TDF duct flange of FIG. 13 and a finished TDF duct flange of FIG. 14.

DETAILED DESCRIPTION OF THE PREFERRED EMBODIMENTS

Figure 2:
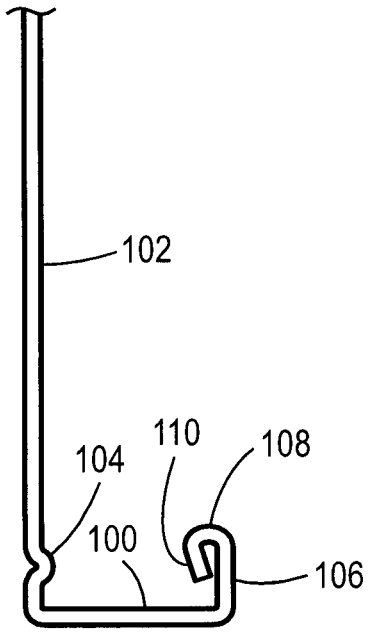
FIG. 2 illustrates the TDF duct flange profile which the apparatus and method of the invention may make.
Figure 3:
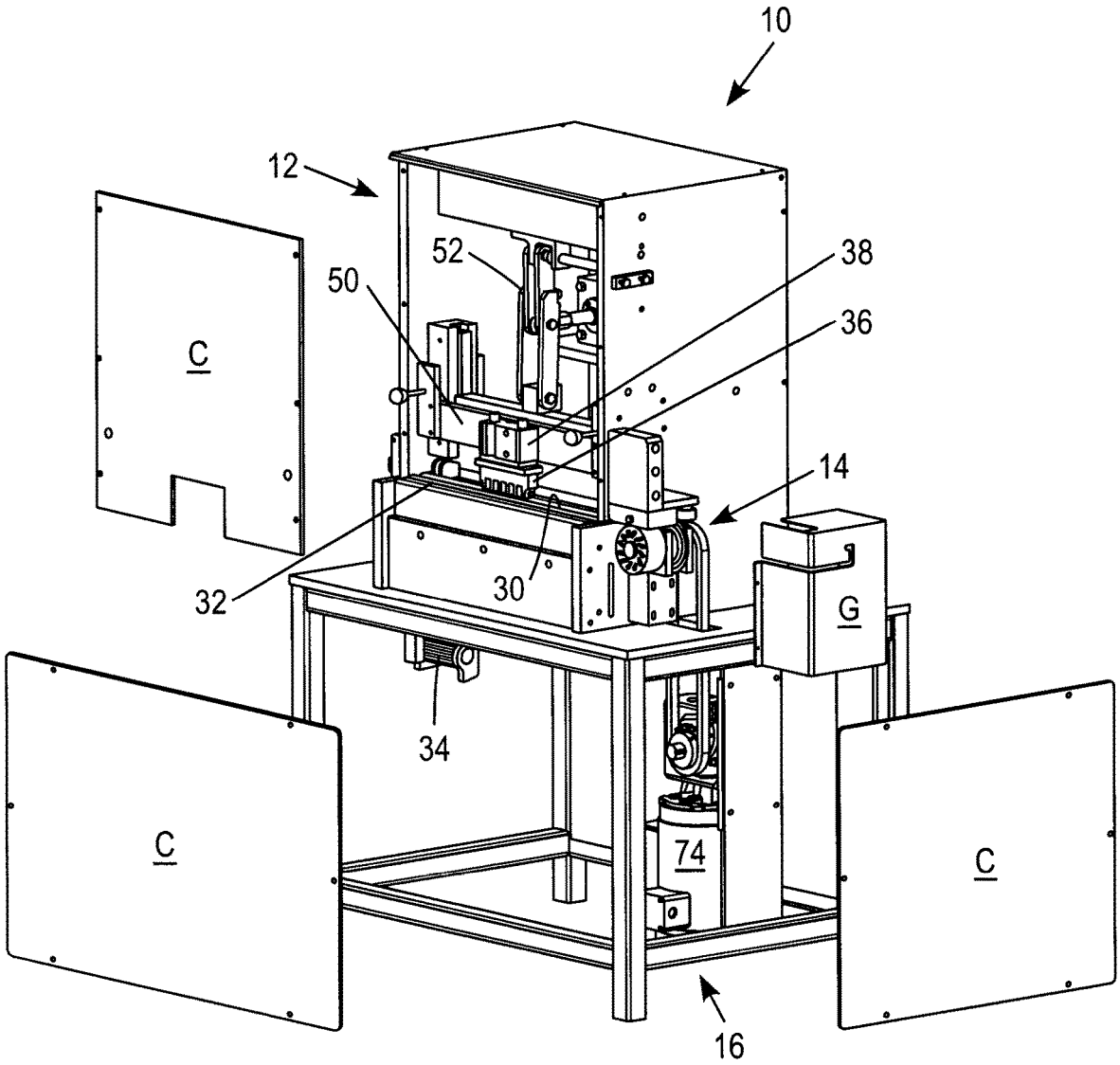
FIG. 3 is a perspective view of the apparatus of the invention with some of the covers and guards removed.

The apparatus and method of the present invention provide for the manufacture of a duct flange profile and a duct, and particularly a TDF or TDC duct flange profile. The duct flange profile is directed to small part duct fittings with section widths up to about 16 inches in 20 to 26 gauge metal. The presently preferred embodiment of the invention is directed to the manufacture of a TDF duct flange profile. A TDF profile is shown in FIG. 2 and includes a web portion 100 extending at 90 degrees from the duct wall 102, with an outward-formed tracking bead or ridge 104 spaced inwardly thereof and formed outwardly of the surface of the assembled duct wall 102. At the outer extremity of the web 100 is an outer flange 106 having a turned-under rounded edge 108, formed at an angle slightly in excess of 180 degrees and terminating in a spring margin 110 which extends back toward the web 100 and normally stands inwardly away from the outer flange 106. The spacing between the web 100 and the tracking bead or ridge 104, which corresponds to the spacing from the web 100 of the somewhat bulbous rounded portion of the turned-under edge 108, is fixed to accommodate the side edges of an arm of a corner connector. The depth between the spring margin 110 and the outer surface of the duct wall 102 between the bead or ridge 104 and the web 100, is such that the leg portions of a corner connector will snap into position in the flange. In practice, it is useful to crimp the flange 106 over the corner connector to keep the corner connector in the duct flange. This may be done with a CORNERMATIC® machine. The invention will be described herein with respect to the manufacture of a TDF profile. However, it is understood that the apparatus and method of the present invention may be useful in the manufacture of a TDC profile.

The apparatus may create a small parts duct fitting in substantially less time than the known apparatus and may include a cycle time of approximately nine seconds thereby increasing productivity by at least six times. The apparatus and method of the present invention will produce a duct and duct flange having a TDF profile meeting the SMACNA T-25B profile standards.

As seen in the Figures, the operation and various components parts of the apparatus are shown therein. The apparatus and method is automatic and provides for a self-feed operation. One just loads a piece of sheet metal for forming the duct flange and steps on a foot switch. The operator does not need to guide the duct through the different steps as seen herein until the flange bending is complete. When the flange bending is complete, the operator will guide the work piece through the bead forming section and out of the apparatus.

Referring to the Figures, there is shown an apparatus 10 for making a TDF profile flange meeting the SMACNA T-25B profile. The apparatus 10 generally includes a bending head assembly 12, a roll form assembly 14, a base assembly 16, an electronic control unit 18 (FIG. 4), an air preparation unit 20 and a valve assembly 22.

The bending head assembly 12 includes a platen 30 for receiving a piece of sheet metal which is to be bent to form the TDF flange. There is a drive roller 32 powered by a drive servo motor 34. The drive roller 32 receives the sheet metal and moves the sheet metal forward or backward. When starting the process, the sheet metal is placed on platen 30 and covers drive roller 32 and the sheet metal engages drive roller 32 for movement of the sheet metal. The operation of the apparatus in conjunction with the drive roller 32 is discussed hereafter with respect to the forming of the TDF flange.

There is a pressure roller 36 operated by a cylinder 38 attached to an air source and controlled by the air preparation unit 20 and valve assembly 22. The pressure roller 36 moves up and down and will move downward to engage the sheet metal when in operation. The pressure roller 36 includes a yoke 40 having one or more rollers 42. Connected to yoke 40 is the cylinder 38 for receiving an air source for moving the pressure roller 36 up and down.

There is a bending anvil 50 which will move up and down and is moved by an anvil toggle 52 powered by a toggle cylinder 54 attached to an air source and controlled by the air preparation unit 20 and valve assembly 22. The anvil toggle 52 comprises a lower link 56, an upper link 57 and a cylinder yoke 58. Lower link 56 is attached to anvil 50 and upper link 57 is attached to the machine frame. They are joined at the cylinder yoke 58. Toggle cylinder 54 is preferably a back-to-back cylinder having a first cylinder 54A and a second cylinder 54B. The cylinder is adapted to move the bending anvil 50 to at least four different positions, namely, a down position where the bending anvil 50 engages the sheet metal, up about 0.02 inches, up about 3/16 of an inch or up about 3/8 of an inch. It is understood that this movement may vary without departing from the scope of the invention.

As seen hereafter, this movement is programmed depending on the bending step of the sheet metal.

Figure 6:
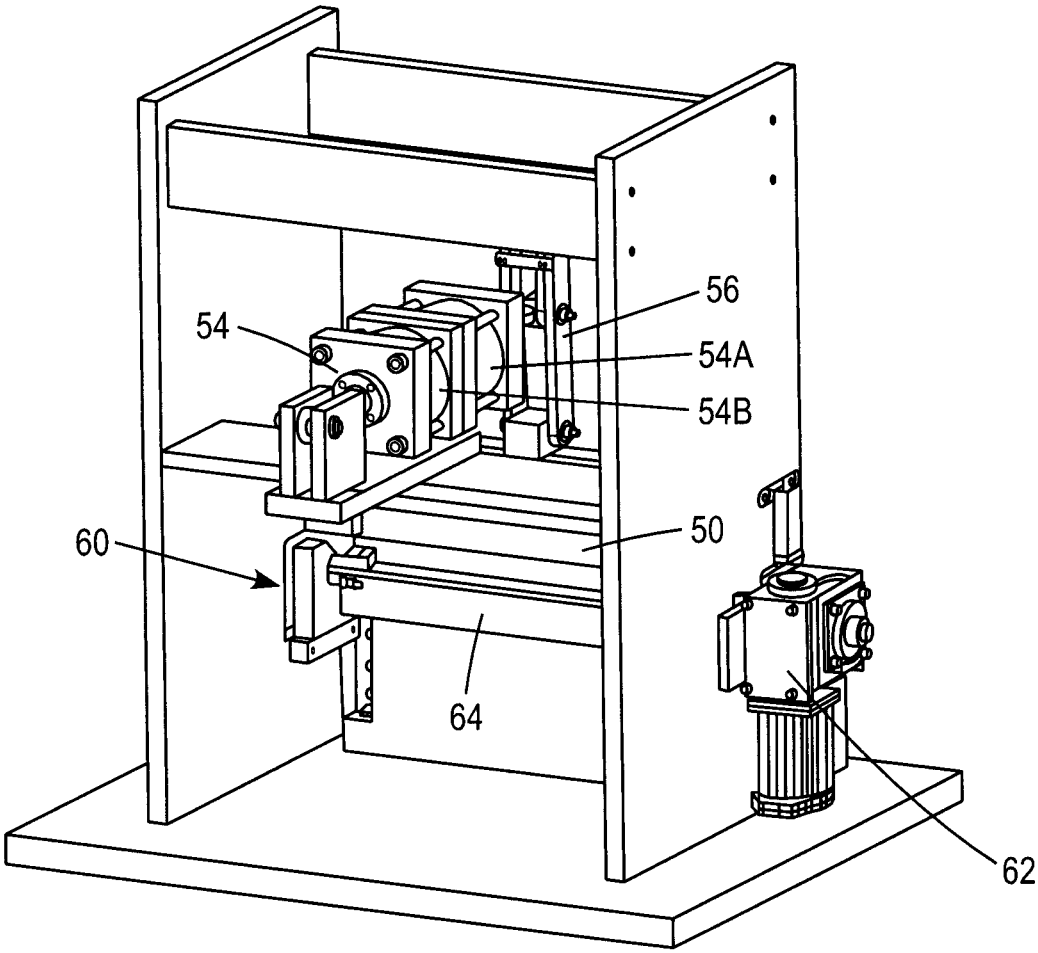
FIG. 6 is a rear view of the bending head assembly of FIG. 5.
Figure 7:
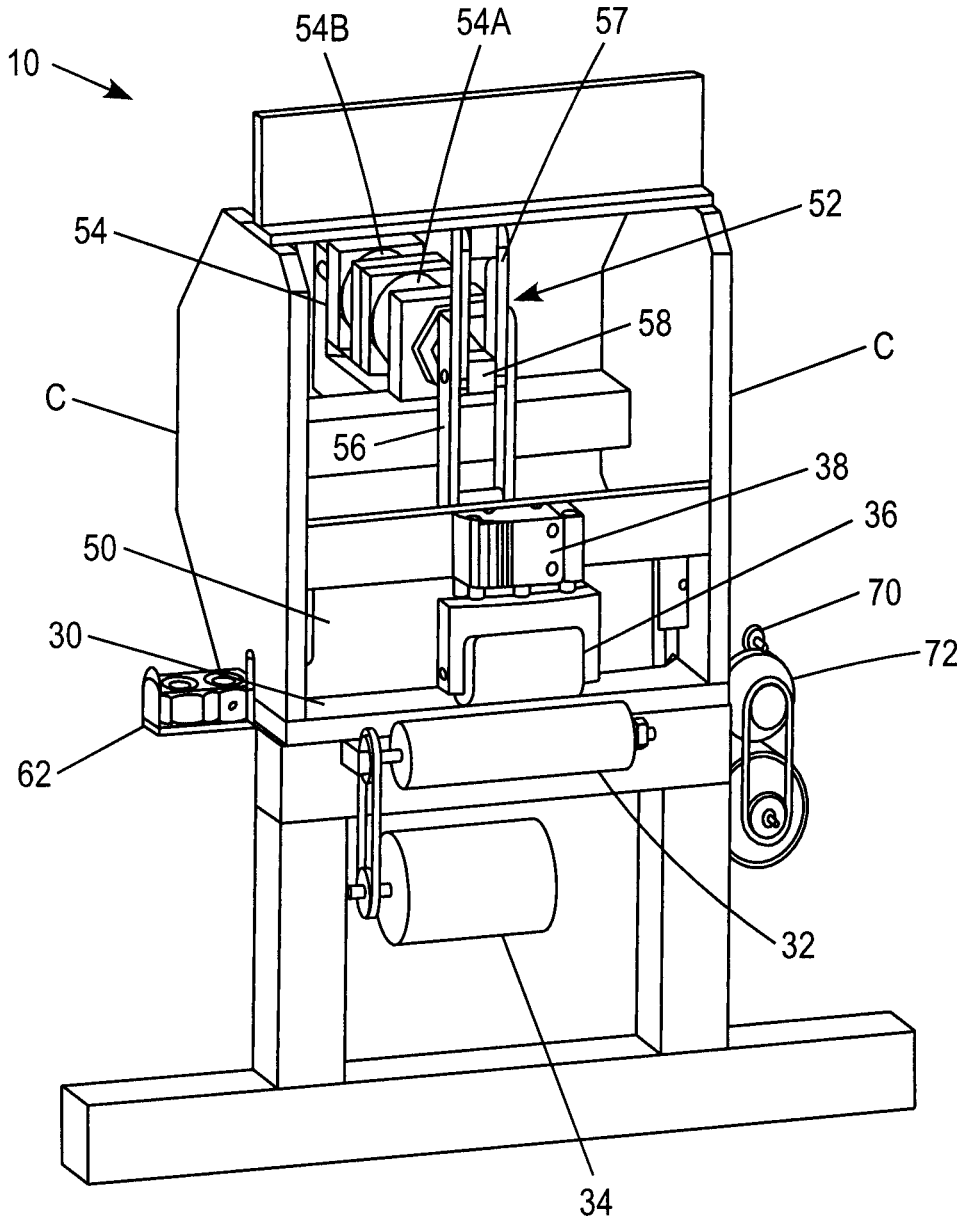
FIG. 7 is another perspective view of the apparatus of the invention (not showing the electronic control unit).
Figure 8:
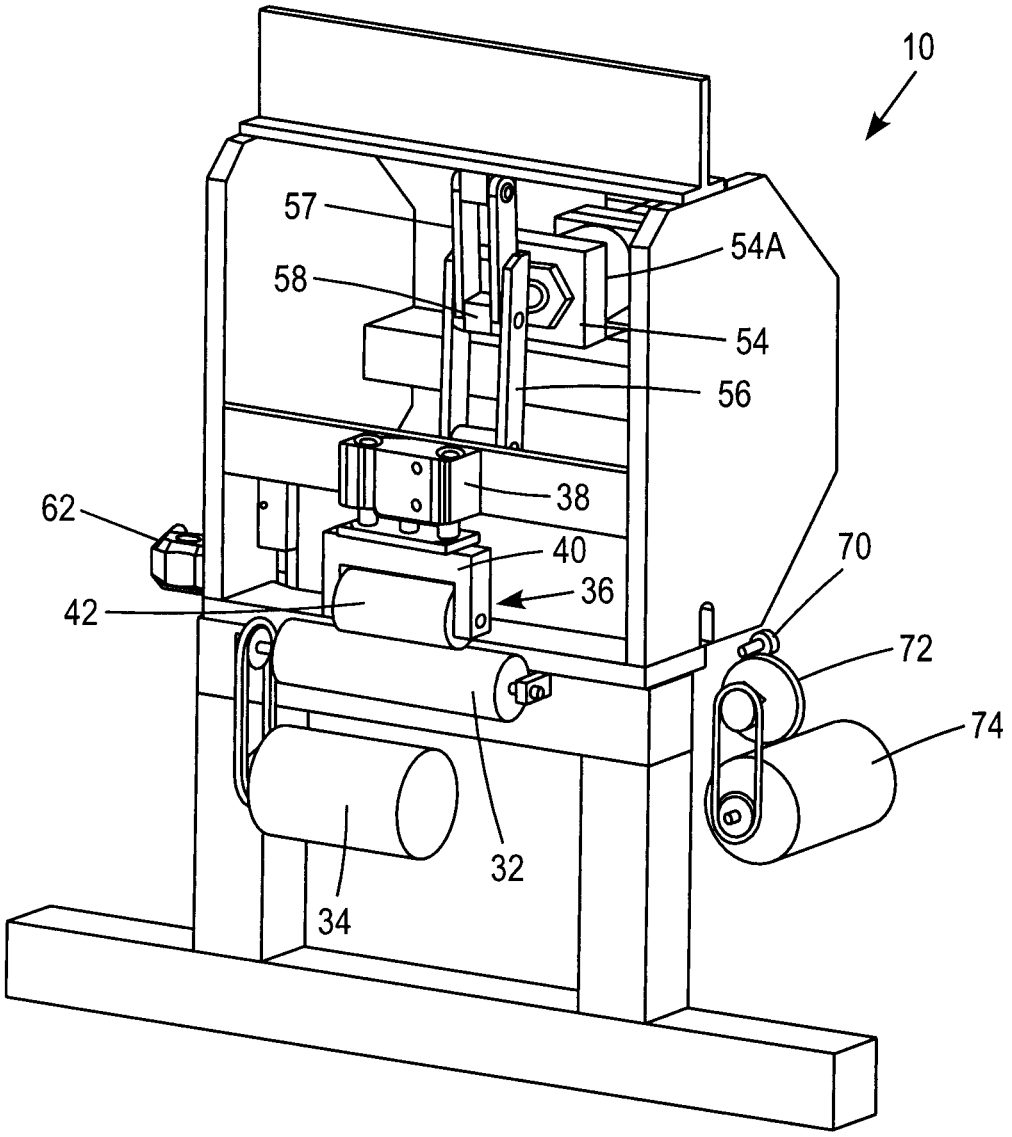
FIG. 8 is another perspective view of the apparatus of FIG. 7.
Figure 9:
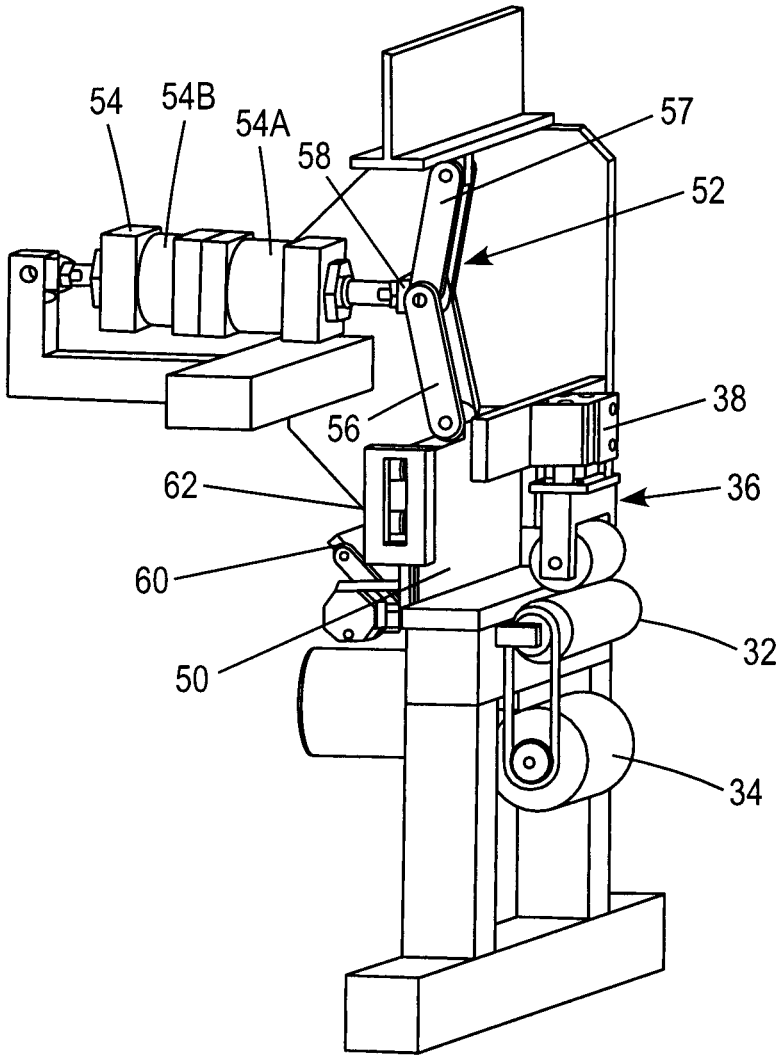
FIG. 9 is a partial side view of the apparatus of FIG. 7.
Figure 11:
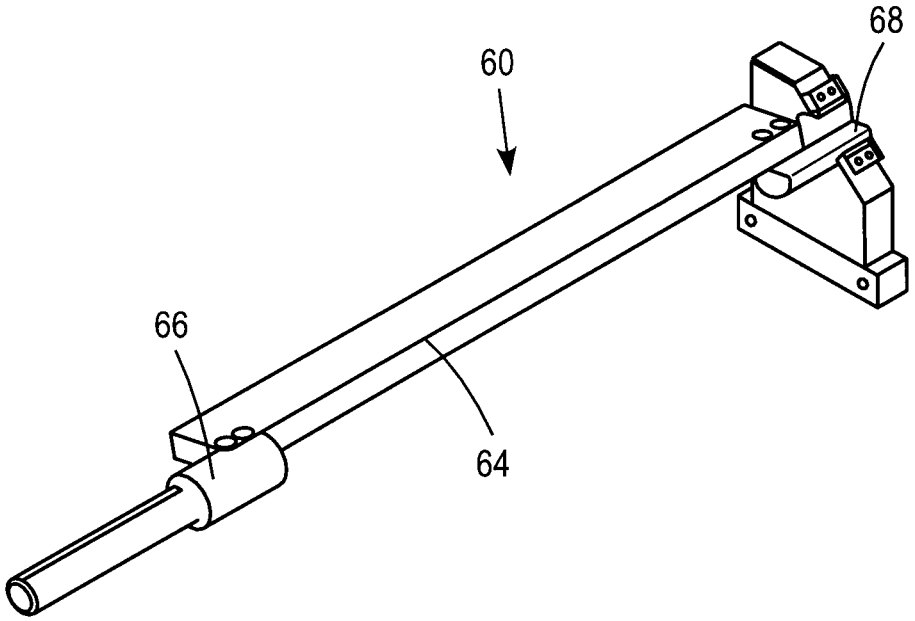
FIG. 11 shows a close up of the bending leaf assembly.

There is a bending leaf assembly 60 which aids in the bending of the sheet metal. Bending leaf assembly 60 may move by servo motor 62 from a starting 90 degree horizontal position downward 90 degrees, back to the starting 90 degree horizontal position or from the downward position to a 135 degree position. The bending leaf assembly 60 as shown, for example, in FIGS. 6, 9 and 11, comprises bending leaf 64, hinge pin 66 for attachment to the servo motor 62 through the apparatus side wall and hinge pin 68 supporting the other end of the bending leaf assembly for movement of bending leaf 64 and attachment to the apparatus.

Figure 13:
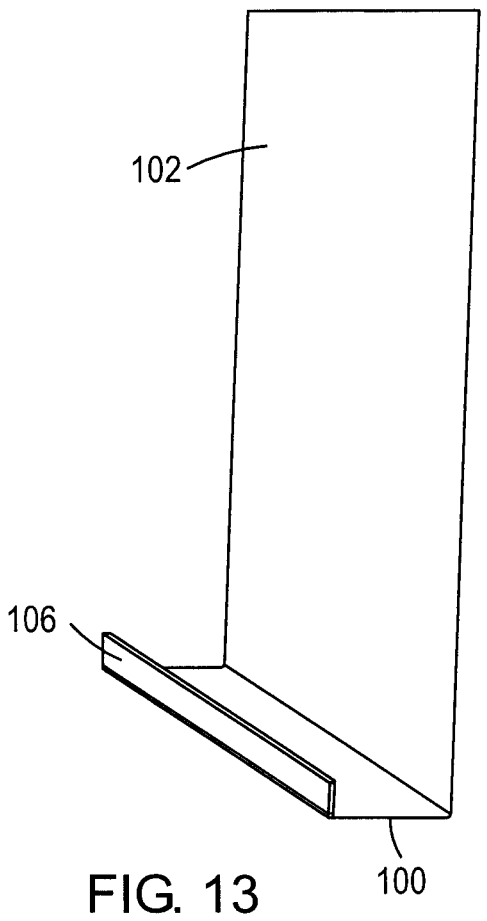
FIG. 13 shows an intermediate TDF duct flange.

These aforesaid components of the bending head assembly 12 form a first portion of the TDF profile as shown in FIG. 13. The remaining portion of the TDF profile is formed by a roll form assembly 14 comprising an upper head roller 70 and a lower bead forming roller 72 powered by a motor 74 in base 16.

Base 16 houses air preparation unit 20 including pressure regulator 21, valve assembly 22, bending servo motor 34 and roll form assembly motor 74. The apparatus 10 may include covers C and guards G.

Figure 4:
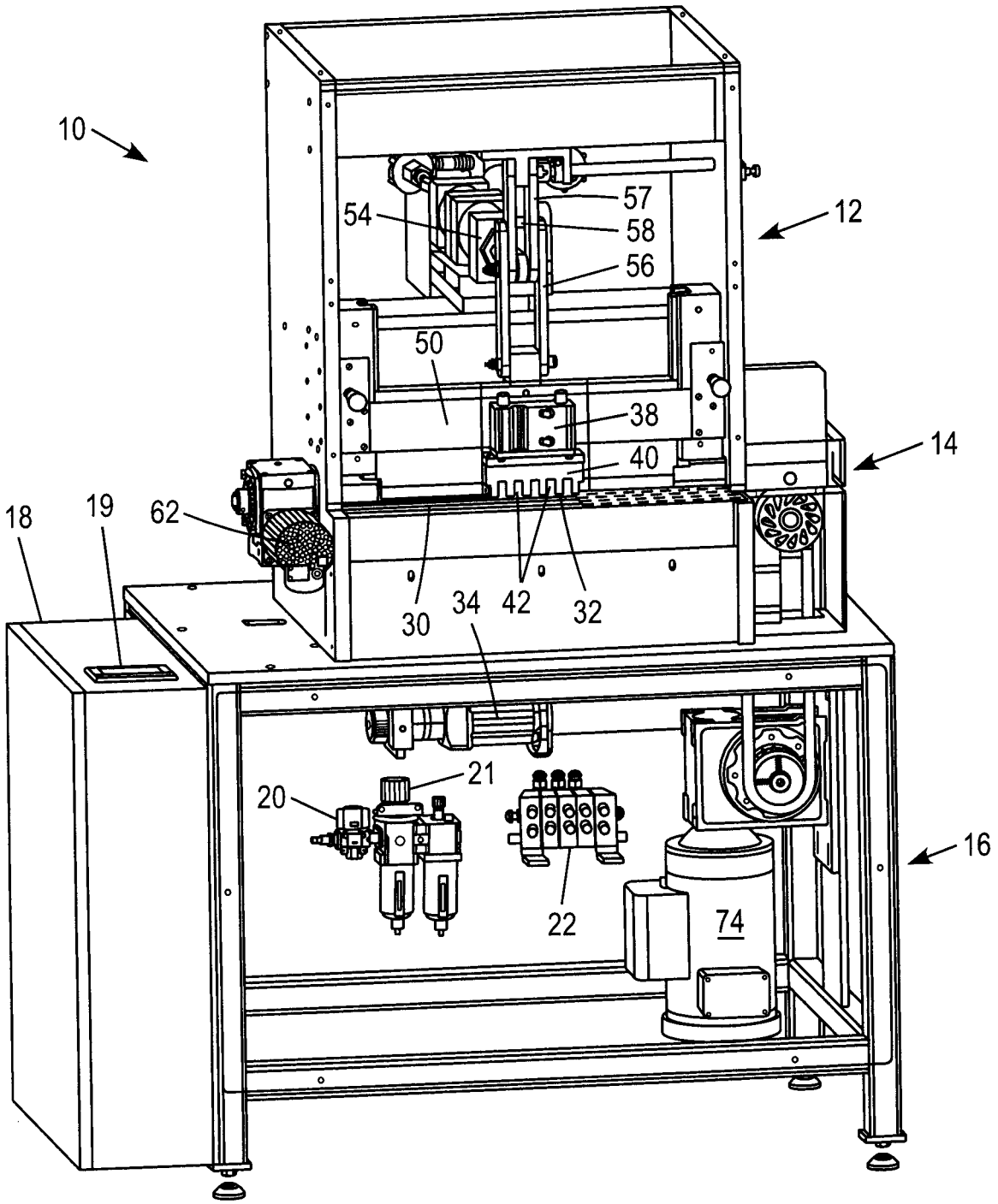
FIG. 4 is a front view of the apparatus of FIG. 3 without some of the covers and guards and showing the electronic control unit.
Figure 5A:
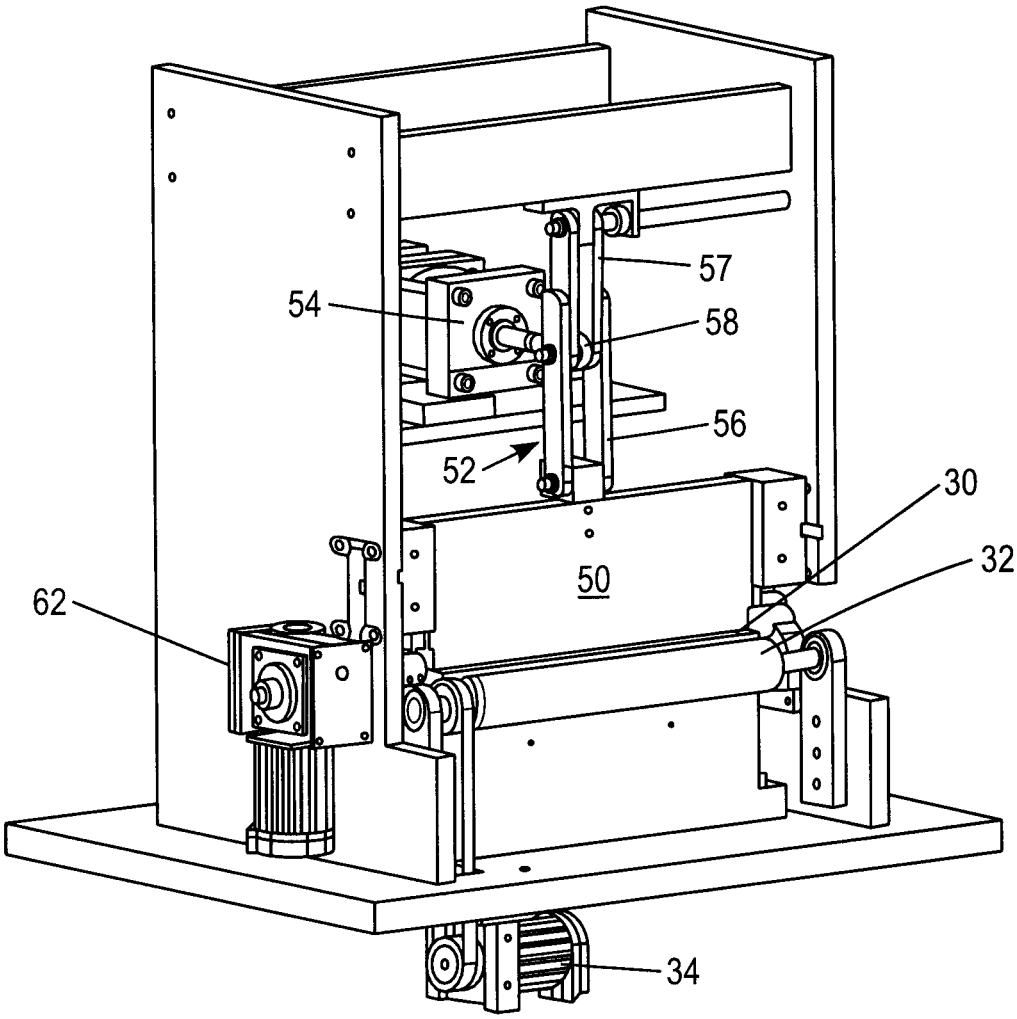
FIGS. 5A and 5B are front views of the bending head assembly of the apparatus of FIG. 3 without the pressure roll assembly.
Figure 5B:
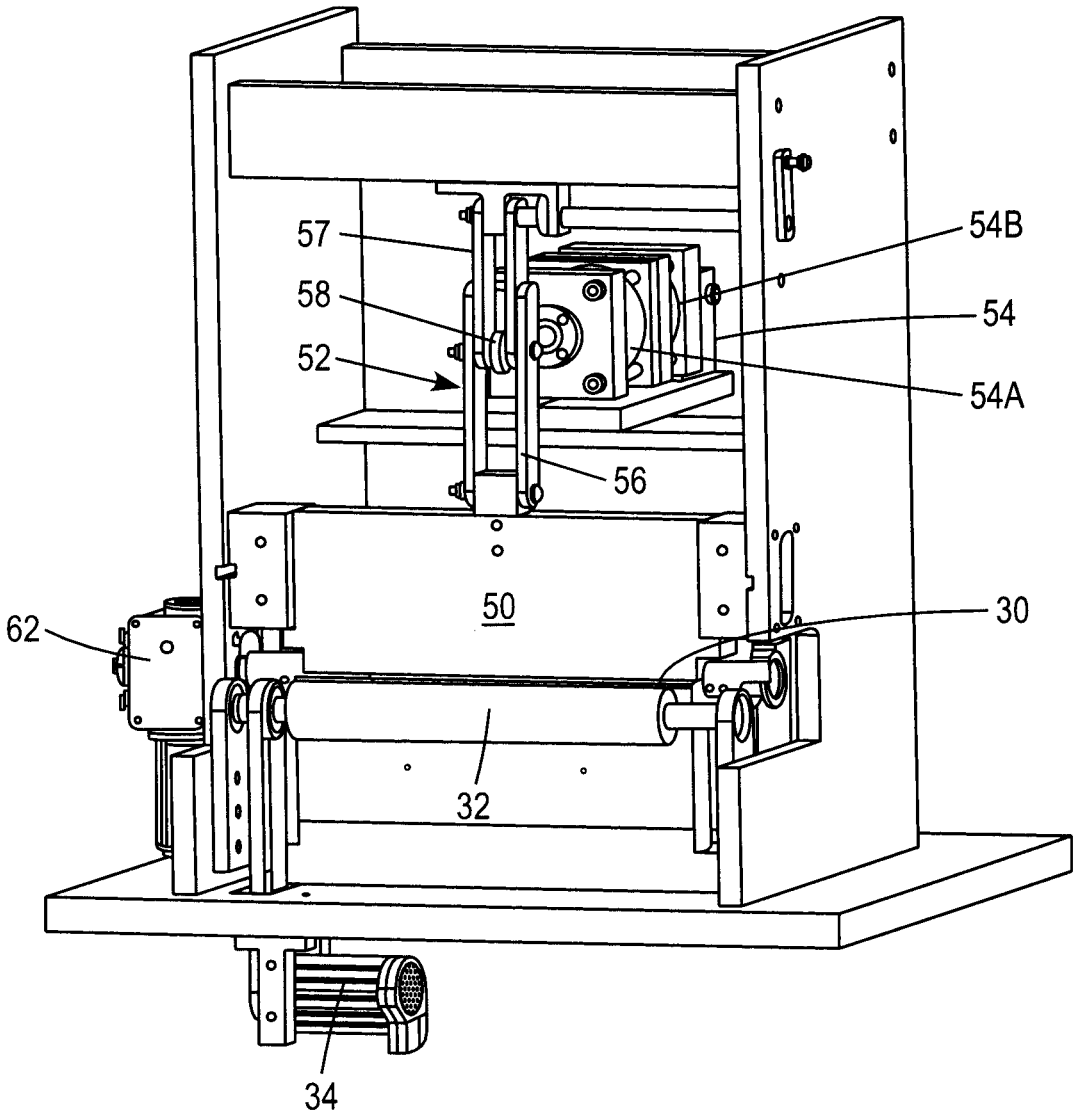

Referring to FIG. 4, there is shown an electronic control unit 18 (not shown for convenience in the other Figures). Electronic control unit 18 includes an operation mechanism 19 having an on/off switch for starting the apparatus 10. Preferably, the starting mechanism is a foot switch (not shown) connected to the electronic control unit 18. Electronic control unit 18 comprises the electronics adapted to control the operation of the machine, including a programmable logic controller, motor starter and overload devices.

Figure 10:
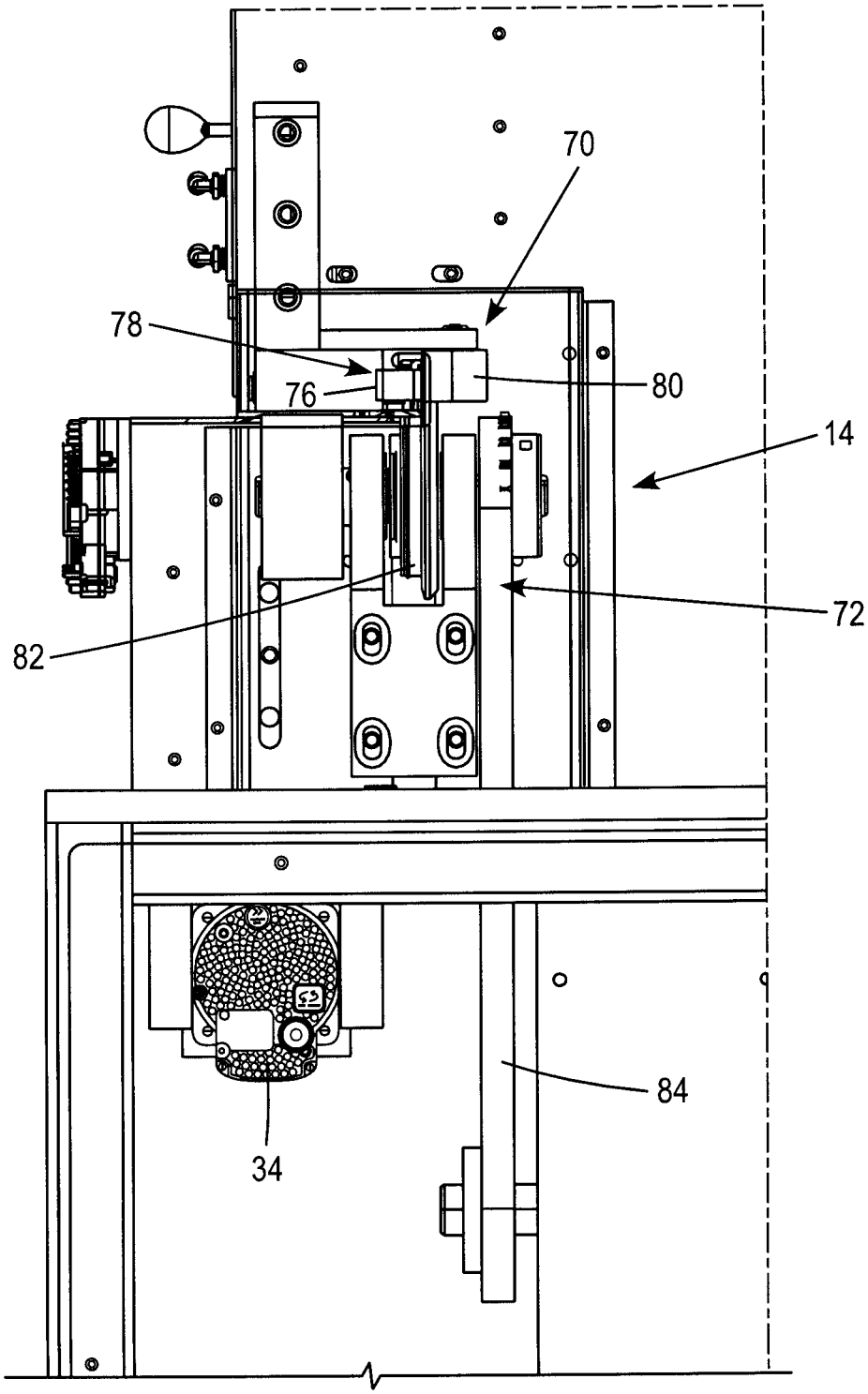
FIG. 10 is a partial side view of the apparatus of FIGS. 3 and 7 showing the roll form assembly.

Referring, for example, to FIGS. 4 and 10, there is shown a close up of the roll form assembly 14. The roll form assembly 14 comprises an upper head roll 70 and a lower bead forming roll 72 powered by a motor 74 in base 16. The upper head roll 70 include two rollers 76 and 78 (behind roller 76) for engaging the sheet metal after the flange has been formed and held in place by bracket 80. The lower bead forming roll 72 includes a bead member 82 which engages the sheet metal to form the bead in conjunction with the rollers 76 and 78. The bead member 82 is rotated by an assembly 84 powered by motor 74. The operation of the roll form assembly 14 will be described in greater detail hereafter.

Referring to the Figures, the apparatus and method of forming a TDF flange for making a small duct fitting will now be further explained, including the function of the various components of the apparatus as discussed above. In preface, the invention uses sheet metal brake technology to bend the sheet metal to form the TDF duct flange. The anvil 50 is used to clamp the metal for bending and is actuated by anvil toggle 52 driven by the back-to-back tandem cylinders 54A and 54B of toggle cylinder 54. Cylinder 54A is ½ in stroke and will raise and lower the clamping anvil 50 approximately 0.02 inches. Cylinder 54B is 1½ in stroke and will raise and lower the clamping anvil approximately ⅜ of an inch. The sheet metal blank is manually loaded and positioned against the bending leaf 64 in the 90 degree start position. All positioning and bending will be performed automatically after pressing the start button 19. A servo motor driven feed roller 32 is used to position the metal for bending and a servo motor driven bending leaf 64 will perform the bending, all as described in further detail below.

The operation mechanism 19 on control panel 18 is provided for set up of the machine, running of the machine and stopping of the machine. The sheet metal is inserted on platen 30. The stop switch may be pushed to stop operation of the apparatus. The electronic control unit 18 is preferably connected to a foot switch (not shown) which is used to start the process.

Referring to FIG. 12, there is shown steps 1-13 describing the apparatus and method of the invention for forming a TDF flange for making a small duct fitting. Step 1 shows the start position. The sheet metal is inserted into the apparatus under pressure roller 36, over drive roller 32 and underneath anvil 50. The bending leaf 64 is at a 90 degree angle and provides a loading stop. Anvil 50, by cylinder 54A being retracted and cylinder 54B being extended, is up for loading. The foot switch is engaged to start the process to automatically make the TDF flange.

In step 2, the pressure roller 36 is driven down to clamp the sheet metal against the drive roller 32 driven by the servo motor 34. The anvil 50 is still up.

In step 3, the bending leaf 64 is rotated downward, the anvil 50 is still in the up position and the metal is advanced by drive roller 32 and servo motor 34 to position the sheet metal for making a hem prebend.

In step 4, the anvil 50 is moved downward by toggle 52, cylinders 54A and 54B being extended, to clamp the sheet metal against the platen 30.

In step 5, the bending leaf 64 is rotated by servo motor 62 about 135 degrees to overbend the metal for making the hem prebend.

In step 6, the anvil 50 is raised about 0.020 inch by cylinder 54A being retracted and the metal is advanced by drive roller 32 and servo motor 34 so that the hem prebend and the metal is past the anvil. The bending leaf 64 is rotated downward by servo motor 62.

In step 7, anvil 50 is raised so that the hem prebend can fit under the anvil 50 with cylinders 54A and 54B being retracted. The metal is retracted to a position such that the hem prebend is under the anvil 50.

In step 8, cylinders 54A and 54B extend to drive the anvil down flattening the hem prebend and forming the hem.

In step 9, the anvil 50 is raised to release the metal by retracting cylinder 54B. The metal is then advanced by drive roller 32 and servo motor 34 to a position for bending the lip of the metal.

In step 10, the anvil 50 is moved downward by extending cylinder 54B and then bending leaf 64 is rotated upward to a 90 degree angle to bend the lip of the sheet metal in forming the outer flange 106 of the TDF flange.

In step 11, the bending leaf 64 is rotated downward, anvil 50 is raised up about 0.20 inches to release the metal by retracting of cylinder 54A and the metal is advanced by drive roller 32 and servo motor 34 to a position for bending the flange to form web 100.

In step 12, the anvil 50 is driven down to clamp the metal by extending cylinder 54A. The bending leaf 64 is rotated up 90 degrees to bend the flange to form web 100. At this point in the process, as shown in FIG. 13, there is a completed flange ready for roll forming the bead 104 to provide the TDF duct flange.

Figure 14:
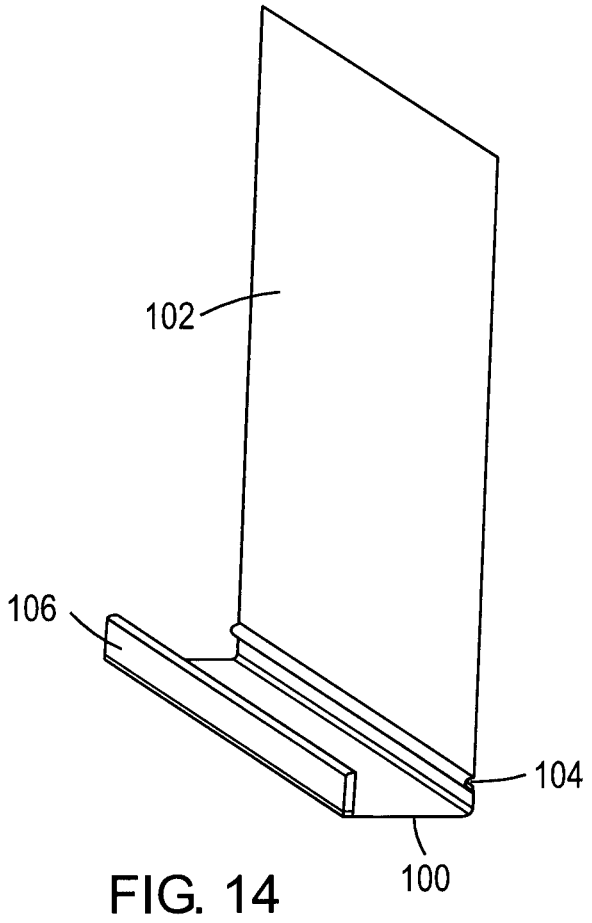
FIG. 14 shows a finished TDF duct flange.

In step 13, pressure roller 36 is raised, anvil 50 is raised by retracting cylinder 54A and the sheet metal with the flange is manually slid out the right side of the apparatus 10 through the roll forming assembly 14 to form the bead 104 of the TDF flange in the sheet metal. The roll forming assembly includes an upper head having rollers 76 and 78 and a lower bead forming assembly having a roll forming beading member 82. As shown in FIG. 14, the TDF profile flange is now completed and complies with SMACNA T-25B profile standards.

Figure 1:
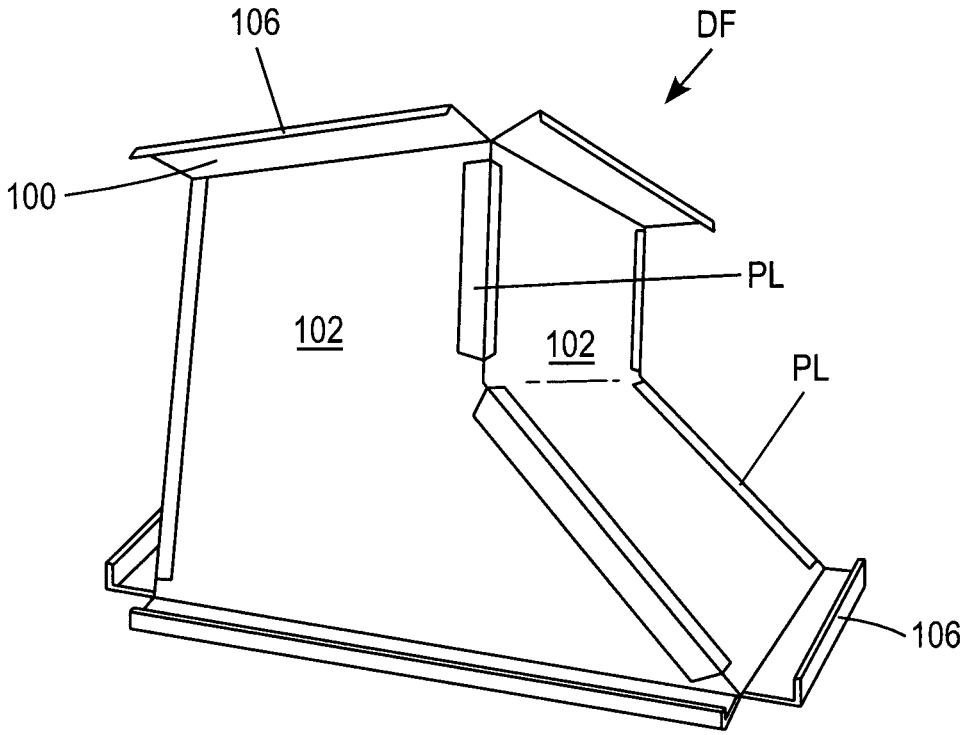
FIG. 1 shows an example of a small duct fitting, the apparatus and method of the invention may make the duct flanges comprising the duct fitting.

A sheet metal contractor will then join four of the TDF flanges of FIG. 14 by known connection means, such as a Pittsburgh Lock or a Snap Lock, to form a small duct fitting. For example, FIG. 1 shows a small duct fitting DF with TDF duct flanges as shown in FIGS. 2 and 14 joined together by a Pittsburgh Lock PL (bend 104 is not shown for convenience). The sheet metal may be 20 gauge to 26 gauge and the duct fitting may be of various shapes.

The apparatus and method of the present invention provides a simple and inexpensive manufacture of a small parts duct fitting having a TDF or TDC profile. The apparatus and method saves substantial time in the manufacture of small part duct fittings having a TDF or TDC profile, thereby saving duct manufacturers substantial time and money in the manufacturing process. The apparatus and method are simple in construction and operation and durable in use.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. An apparatus for making a transverse duct flange (TDF) flange for use in the manufacture of a small duct fitting comprising a bending head assembly adapted to make an intermediate TDF flange profile for the small duct fitting having a duct wall, a web and a flange, and a roll form assembly adapted to make a bead of a TDF flange profile, the roll form assembly comprising an upper head roller and a lower bead forming roller, wherein the bending head assembly first makes the intermediate TDF flange profile and the roll form assembly thereafter makes the TDF flange bead in the intermediate TDF flange profile to complete the TDF flange for the small duct fitting.

2. The apparatus of claim 1 wherein the bending head assembly comprises a platen, a drive roller assembly, an anvil assembly and a bending leaf assembly.

3. The apparatus of claim 2 further comprising a pressure roller assembly.

4. The apparatus of claim 3 wherein the drive roller assembly comprises a drive roller and a drive roller servo motor, the anvil assembly comprises an anvil and an anvil toggle cylinder, the bending leaf assembly comprises a bending leaf and a bending leaf servo motor, and the pressure roller assembly comprises a pressure roller and a pressure roller cylinder.

5. The apparatus of claim 4 further comprising an anvil toggle connected to the anvil and the anvil toggle cylinder.

6. An apparatus for making a transverse duct flange (TDF) flange for use in the manufacture of a small duct fitting comprising a bending head assembly adapted to make an intermediate TDF flange profile for the small duct fitting having a duct wall, a web and a flange, the bending head assembly comprising a platen for receiving a piece of sheet metal to be bent to form the intermediate TDF flange profile, a drive roller to move the sheet metal forward and backwards, an anvil for holding the sheet metal in a fixed position at different points in a process of making the intermediate TDF flange profile, a bending leaf for bending the sheet metal at said different points in the process of making the intermediate TDF flange profile, and a roll form assembly for forming a bead in the intermediate TDF flange profile, the roll form assembly comprising an upper head roller and a lower bead forming roller, wherein the bending head assembly and the roll form assembly form the TDF flange for the small duct fitting.

7. The apparatus of claim 6 further comprising a pressure roller.

8. The apparatus of claim 7 further comprising a drive roller servo motor, a pressure roller cylinder, an anvil toggle cylinder and a bending leaf servo motor.

9. The apparatus of claim 6 wherein the bending head assembly is adapted to make the intermediate TDF flange profile by bending the sheet metal to make a hem prebend, by bending the hem prebend to form the flange, by bending the flange to form a lip on the flange, by bending the flange with the lip to form the web and the duct wall, thereby completing the intermediate TDF flange profile, and the roll form assembly is adapted to make the TDF bead in the duct wall of the intermediate TDF flange profile to complete the TDF flange.

10. A method of making a transverse duct flange (TDF) flange for use in the manufacture of a small duct fitting comprising the steps of a. inserting a piece of sheet metal into an apparatus for making the TDF flange, the apparatus comprising (i) a bending head assembly having a platen, a drive roller assembly, an anvil assembly and a bending leaf assembly, and (ii) a roll form assembly, b. wherein the bending head assembly is adapted to make an intermediate TDF flange profile for the small duct fitting having a duct wall, a web and a flange and the roll form assembly thereafter is adapted to make a TDF bead in the intermediate TDF flange profile to form the TDF flange for the small duct fitting comprising the following steps:

(i) bending the sheet metal by the bending head assembly to make a hem prebend in the sheet metal, (ii) bending the hem prebend by the bending head assembly to form the flange of the intermediate TDF flange profile, (iii) bending the flange by the bending head assembly to form a lip on the flange, (iv) bending the flange with the lip by the bending head assembly to form the web and the duct wall, thereby forming the intermediate TDF flange profile, and (v) moving the intermediate TDF flange profile to the roll form assembly and the roll form assembly forms the TDF bead in the duct wall on the intermediate TDF flange profile, thereby completing the TDF flange for the small duct fitting.

11. The method of claim 10 further comprising a pressure roller assembly.

12. The method of claim 11 wherein the drive roller assembly comprises a drive roller and a drive roller servo motor, the anvil assembly comprises an anvil and an anvil toggle cylinder, the bending leaf assembly comprises a bending leaf and a bending leaf servo motor, and the pressure roller assembly comprises a pressure roller and a pressure roller cylinder.

13. The method of claim 12 wherein the roll form assembly comprises an upper head roller and a lower bead forming roller.

14. The method of claim 10 wherein the roll form assembly comprises an upper head roller and a lower bead forming roller.

* * * * *